US006018911A

United States Patent [19]

Menegazzo

[11] Patent Number: 6,018,911

[45] Date of Patent: Feb. 1, 2000

[54] MULTI-PURPOSE WINDOW CONSTRUCTION WITH A SHUTTER OF THE JUTTING AND BASCULE TYPE

[75] Inventor: Giovanni Menegazzo, Monroe, N.J.

[73] Assignee: Acumold Inc., East Brunswick, N.J.

[21] Appl. No.: 09/072,447

[22] Filed: May 5, 1998

[30] Foreign Application Priority Data

May 9, 1997 [IT] Italy ..... MI97A01079

[51] Int. Cl.[7] ..... E05D 15/10; E05D 15/58

[52] U.S. Cl. ..... 49/213; 49/260; 49/504

[58] Field of Search ..... 49/260, 213, 216, 49/208, 209, 211, 153, 157, 407, 152, 158, 176, 177, 181, 182, 504

[56] References Cited

U.S. PATENT DOCUMENTS

| | | | |
|---|---|---|---|
| 1,087,243 | 2/1914 | Kurz | 49/260 |
| 1,690,385 | 11/1928 | Tunez | 49/260 |
| 1,713,841 | 5/1929 | Lewis | 49/157 |
| 1,778,978 | 10/1930 | Kotler | 49/157 |
| 2,585,678 | 2/1952 | Preston | 49/157 |
| 2,590,028 | 3/1952 | Miller | 49/260 |
| 2,623,767 | 12/1952 | Persson | 49/260 |
| 2,850,773 | 9/1958 | Brimmer | 49/208 |
| 2,928,116 | 3/1960 | Bengtsson | 49/260 |
| 4,727,680 | 3/1988 | Lewis et al. | 49/260 |

*Primary Examiner*—Daniel P. Stodola
*Assistant Examiner*—Curtis A. Cohen
*Attorney, Agent, or Firm*—Browdy and Neimark

[57] ABSTRACT

A multi-purpose window frame with a shutter of the jutting and bascule type is disclosed, which comprises: a fixed framework (2) internally having horizontal (6) and vertical (7) borders, a mounting opening (3) delimited by said borders (6, 7), a shutter (4) insertable in the mounting opening (3) and externally having horizontal (10) and vertical (11) sidepieces to be positioned adjacent to the fixed framework borders (6, 7), and connecting structure extending between the shutter (4) and framework (2) and comprising pivot pins (15) and seatings (20) for the pins, the connecting structure comprising two pairs of pivot pins (15), each projecting from one of the vertical sidepieces (11) of the shutter (4) and each insertable in an adjacent vertical border (7), and guide channels (16) formed in the vertical borders (7), to be traveled over by said pivot pins (15) and internally forming pairs of seatings (20) defining steady positions of the shutter (4).

12 Claims, 3 Drawing Sheets

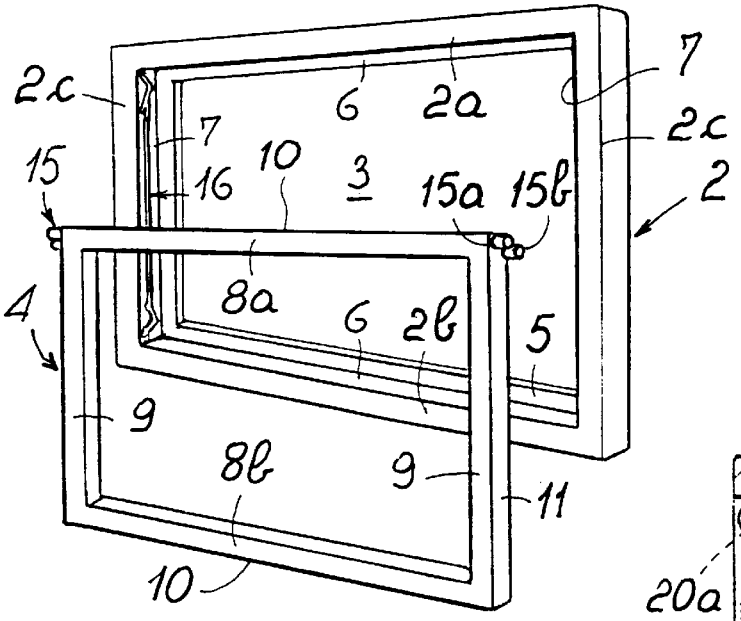
Fig. 1
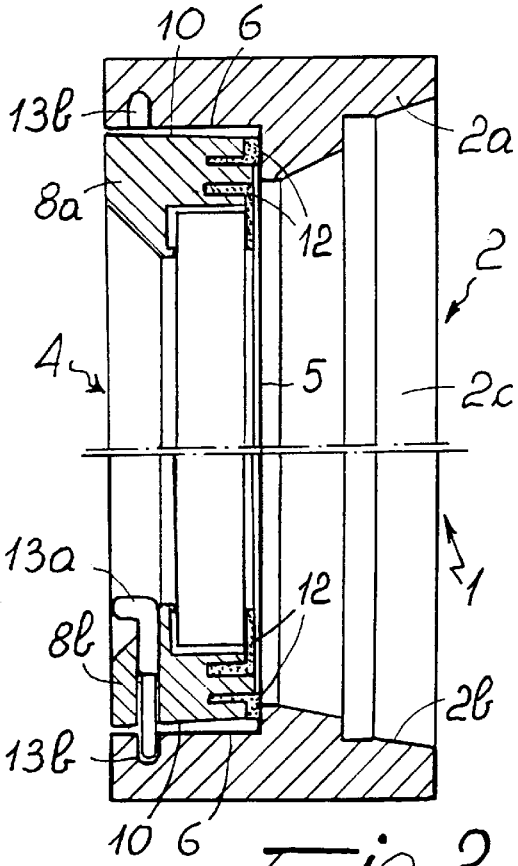
Fig. 2
Fig. 3
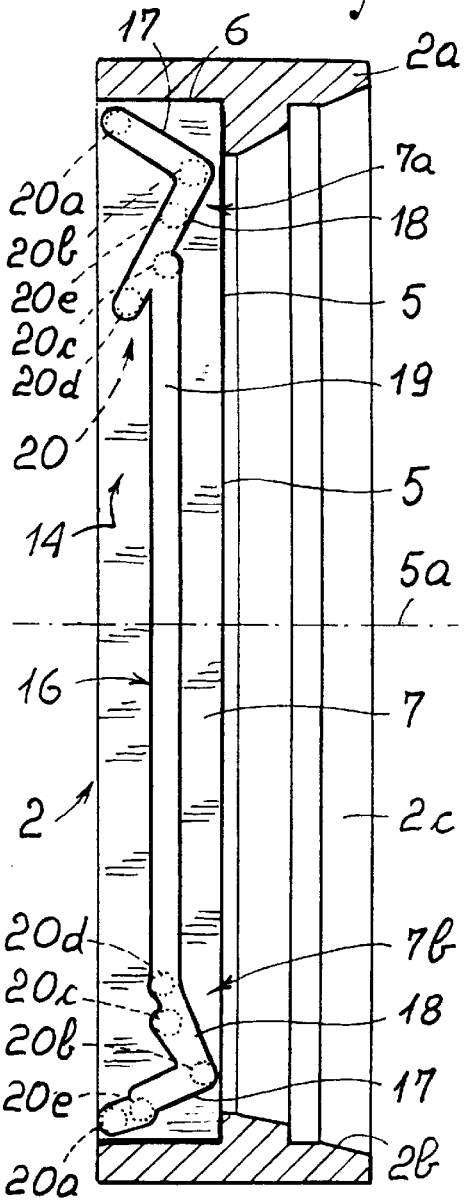

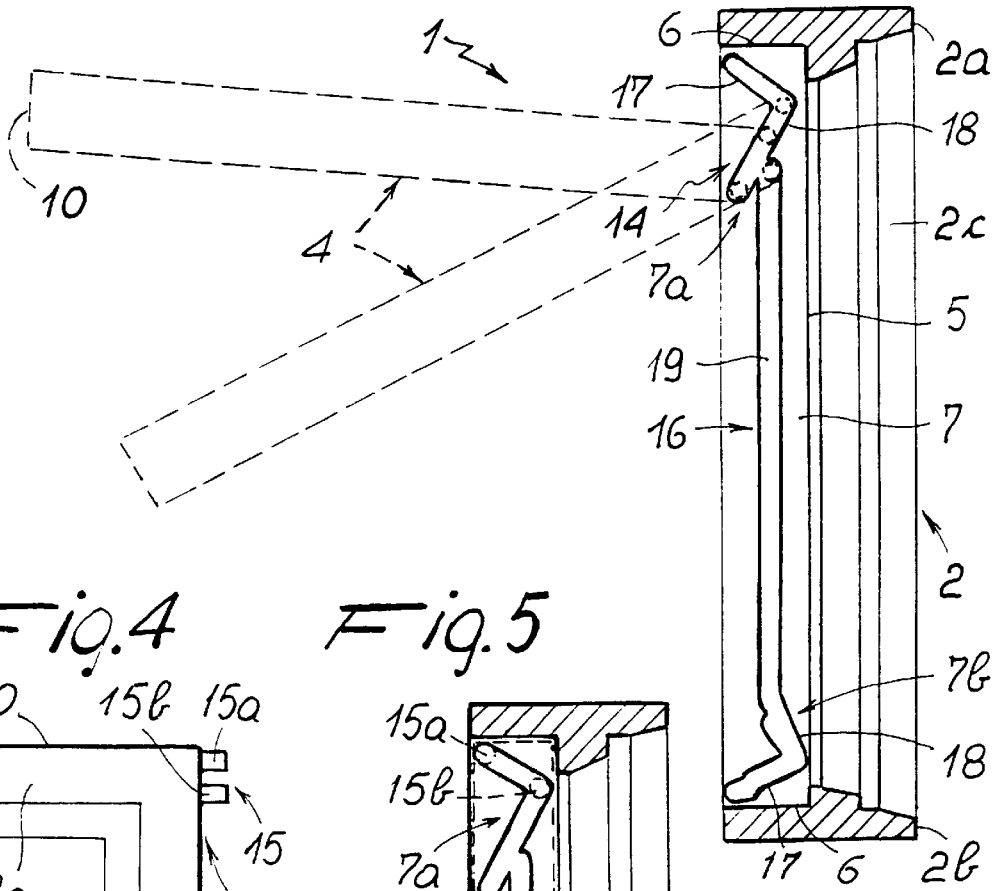
Fig.6
Fig.4
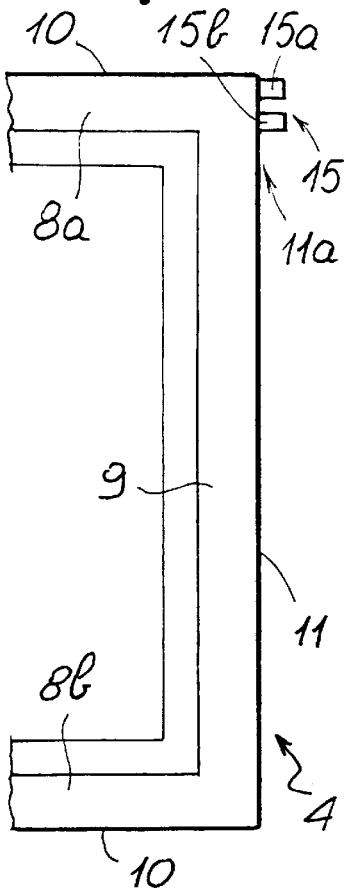
Fig.5
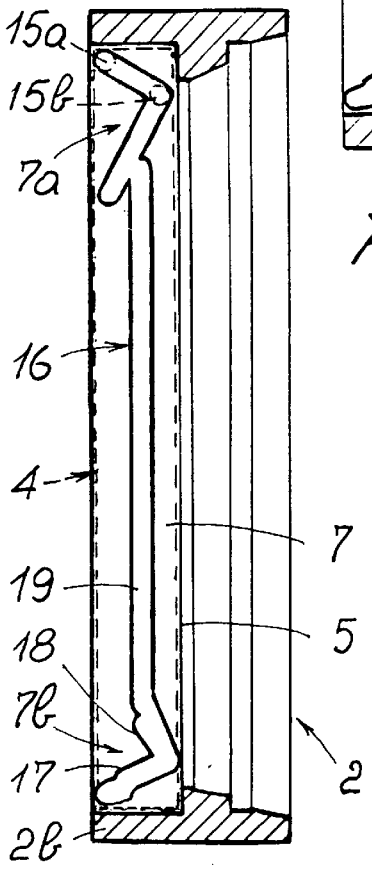

MULTI-PURPOSE WINDOW CONSTRUCTION WITH A SHUTTER OF THE JUTTING AND BASCULE TYPE

FIELD OF THE INVENTION

The invention relates to a multi-purpose window frame with a shutter of the jutting and bascule type.

It is known that window constructions with a shutter of the jutting and bascule type are widespread in the case of small windows having a major horizontal extension and above all for rooms and premises where relatively simple window frames are preferred, such as cellars and attics.

DESCRIPTION OF THE PRIOR ART

These window constructions have a fixed framework delimiting a mounting opening where a shutter of the jutting and bascule type is inserted, said shutter currently consisting of a glazed panel. Also provided are connecting elements engaging the jutting and bascule shutter in a manner adapted to enable rotation of same about a horizontal crosspiece.

Practically the jutting and bascule shutter can rotate in the fixed framework about a horizontal rotation axis extending along an upper or lower horizontal crosspiece thereof.

The rotation axis is defined by hinges or pins in alignment with the rotation axis.

The open position is made steady by appropriate tie rods, if rotation takes place at the lower crosspiece and opening occurs on top, or by struts if rotation takes place at the upper crosspiece and opening occurs at the bottom.

These window constructions have some drawbacks.

A first drawback consists in that purchasers are obliged to make an immediate and definitive choice between an upper opening and a lower opening.

If the shutter opening takes place outwardly, rotation about the upper crosspiece offers the advantage of protecting from rain in the open position as well, but it has the drawback that light passage is reduced, above all if the glass is of the semitransparent type.

On the contrary, rotation about the lower crosspiece enables the maximum light passage, when the window is in the open position, and ensures maximum safety, since the window base is always closed, but if the shutter is open, in case of bad weather there is conveyance of rain inwardly, for example. If the shutter opening takes place inwardly, rotation about the upper crosspiece gives the greatest brightness, but there is also a complete exposure to the inclemency of the weather, whereas rotation about the lower crosspiece gives the maximum of safety.

The optimal choice among the different possibilities alto depends either on the height of these windows from the ground, as said windows are often used as cellar windows and therefore located not very far from the ground level, or on the presence of upper protections, such as balconies located above the windows.

Practically, due to the above variety of situations, the initial choice may prove to be wrong in a second time. In this case it is necessary to intervene by carrying out complicated works for reversing the opening position.

A second drawback resides in that in many cases these windows have either a reduced aperture, due to the difficulty of locking and holding the shutter when the latter is completely in cantilevered fashion, or a single steady open position. For this reason there are also windows the shutter of which is hinged on an axis intermediate the fixed framework: by this solution the shutter is in equilibrium and can be positioned at any angle, even at a completely transverse location relative to the fixed framework.

However, with an intermediate axis, there is a problem in that the open shutter takes up room both inwardly and outwardly. This situation can be unacceptable for practical reasons, when cumbersome bulks are not admitted at the outside or at the inside.

A further drawback of window constructions with a jutting and bascule shutter resides in cost of same: although they are of simple construction, they are expensive, due above all to the presence of hinges and tie rods or struts that need to be arranged in a precise manner and must be strong, due to the cantilevered loads they involve. In addition, all elements must be submitted to a mounting step that, if carried out by qualified staff, greatly increases costs.

SUMMARY OF THE INVENTION

Under this situation the technical task of the present invention is to devise a window construction capable of obviating the above mentioned drawbacks.

Within the scope of this technical task, it is an important aim of the invention to devise a window construction to be used both for shutters rotating about their lower crosspiece, and for shutters rotating about their upper crosspiece.

A further aim is to devise a window construction in which the shutter offers a plurality of open positions, while in the absence of tie rods and struts.

Another important aim of the invention is to devise a window construction formed of a minimum number of elements, which is cheap, strong, of easy setting up and use.

The technical task mentioned and the aims specified are substantially achieved by a multi-purpose window construction with a shutter of the jutting and bascule type comprising: a fixed framework internally having horizontal and vertical borders, and abutment projections defining an abutment plane transverse to and contiguous with said borders, a mounting opening delimited by said borders, a shutter to be inserted into said mounting opening and externally having horizontal and vertical sidepieces to be positioned adjacent to said borders of said fixed framework, and connecting means extending between said shutter and fixed framework and comprising pivot pins and seatings for said pivot pins, said connecting means comprising two pairs of said pivot pins, each projecting from one of said vertical sidepieces of said shutter and each insertable into one of said vertical borders, and channel guides formed in said vertical borders along which said pivot pins can run and internally delimiting a plurality of pairs of said seatings.

BRIEF DESCRIPTION OF THE DRAWINGS

Further features and advantages are highlighted in the detailed description of a window construction in accordance with the invention, illustrated in the accompanying drawings, in which:

FIG. 1 diagrammatically shows the framework and shutter of a window construction in accordance with the invention, in a perspective and exploded view;

FIG. 2 is a vertical section of the construction, in an assembled and closed position;

FIG. 3 shows in a detailed vertical section how the framework of the window construction appears in an isolated position;

FIG. 4 is a front view of a shutter portion, seen in a position of rotation about its upper crosspiece;

FIG. 5 diagrammatically shows an overall section in which the shutter, represented simplified, in chain lines and rotating about its upper horizontal crosspiece, is in a closed position relative to the framework;

FIG. 6 is a diagrammatic overall section in which two open positions of the shutter are shown in chain lines, said shutter being represented simplified and rotating about its upper horizontal crosspiece;

DESCRIPTION OF THE PREFERRED EMBODIMENT

Figure 7:
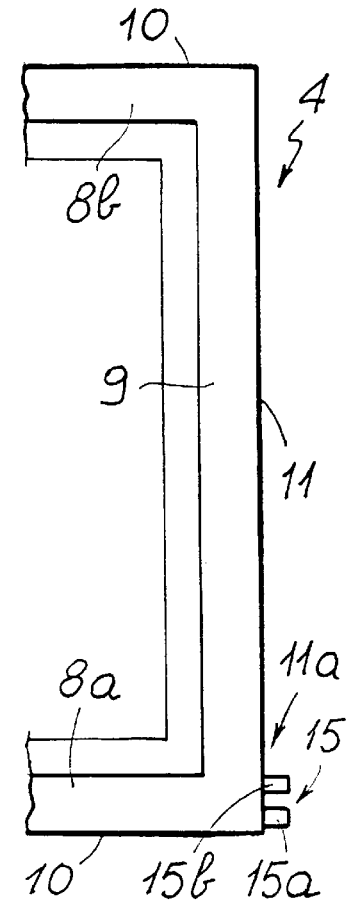
FIG. 7 is a front view of a shutter portion, in the position of rotation about its lower crosspiece.

With reference to the drawings, the window construction in accordance with the invention has been generally identified by reference numeral 1.

It comprises a framework 2 to be fastened to a wall, having shaped rods, horizontal rods 2*a*, 2*b* and vertical rods 2*c*, for example. The horizontal rods in the solution shown are comprised of one upper horizontal rod 2*a* and one lower horizontal rod 2*b*.

Irrespective of how it is made, framework 2 internally delimits at least one mounting opening 3 where a shutter 4, a glazed panel for example, is inserted.

In particular, shutter 4 is inserted against abutment projections defining an abutment plane 5 coincident with the main extension plane of framework 2. Shown in FIG. 3 is a mounting axis, denoted by 5*a*, centrally passing through the mounting opening 3, in a direction perpendicular to the abutment plane 5.

The mounting opening 3 is surrounded by surfaces or borders extending on the inner faces of the shaped rods of framework 2. In particular there are horizontal borders 6 and vertical borders 7, substantially flat and perpendicular to and contiguous with the abutment plane 5.

Shutter 4 is made up of crosspieces and posts and is externally delimited by surfaces or sidepieces that are positioned adjacent to borders 6 and 7 of framework 2.

In more detail, shutter 4 has a first and a second crosspiece 8*a*, 8*b* and posts 9 perpendicular to crosspieces 8*a*, 8*b* and joining the latter.

The first crosspiece 8*a* can substantially rotate about its extension axis when shutter 4 is mounted on the fixed framework 2, whereas the second crosspiece 8*b* is movable and oscillatable for opening and closing shutter 4.

The surfaces or sidepieces on the outer faces of crosspieces 8*a*, 8*b* and posts 9 are divided into horizontal sidepieces 10, located on crosspieces 8*a*, 8*b* and to be positioned adjacent and parallel to the horizontal borders 6 of framework 2, and vertical sidepieces 11 located on posts 9 and to be positioned adjacent to the vertical borders 7 of framework 2. Physical connection between the fixed framework 2 and shutter 4 is obtained by connecting means in particular comprising sealing elements 12, closing elements 13*a*, 13*b* and hinging elements 14.

The sealing elements 12 comprise several different seals made of rubber or plastic material, integral with a shutter 4 face for example, as shown in FIG. 2.

The closing elements, as shown in FIG. 2 as well, comprise a bolt 13*a* passing through the second crosspiece 8*b*, and corresponding cavities 13*b* formed in both the horizontal borders 6.

The hinging elements 14 enable rotation of shutter 4 about its first crosspiece 8*a* and extend both close to pivotal-mounting regions 11*a* on the vertical sidepieces 11 of shutter 4, and close to opposed support regions 7*a*, 7*b* on the vertical borders 7 of framework 2.

As shown in FIGS. 1, 4 and 7, each of the vertical sidepieces 11 of shutter 4 has a pivotal-mounting region 11*a* which is in alignment with the first crosspiece 8*a* and from which a pair of cylindrical pivot pins 15 emerge that are perpendicular to the vertical sidepieces 11 and extend to the vertical borders 7.

In each pair there is a first pivot pin 15*a* and a second pivot pin 15*b* which are spaced from each other by a distance corresponding to the shutter 4 thickness.

The first pivot pin 15*a* is the farther from the abutment plane 5, when shutter 4 is in the closed position, and is located at one end of the related vertical sidepiece 11, at the boundary with a horizontal sidepiece 10.

Practically, the first pivot pin 15*a* emerges from 8 corner of the vertical sidepiece 11.

Figure 8:
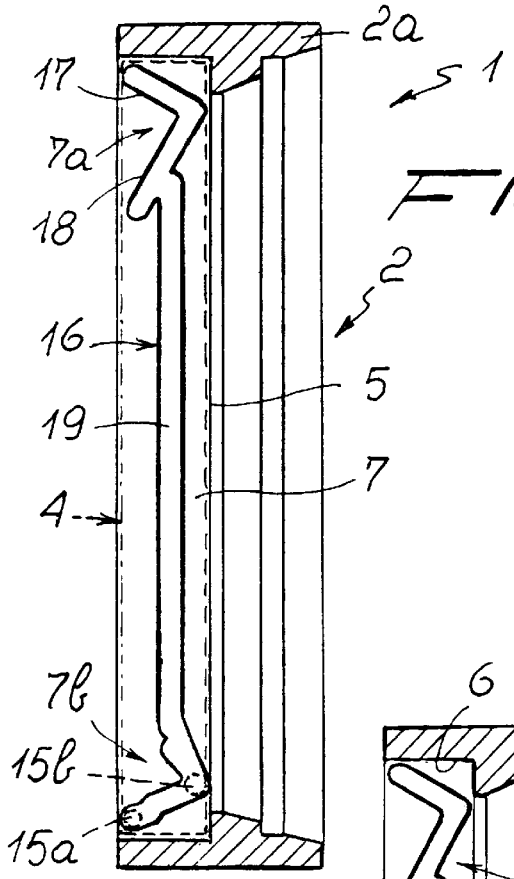
FIG. 8 is an overall section in which the shutter, represented simplified, in chain lines and rotating about its lower horizontal crosspiece, is in a closed position relative to the framework.

In addition, pivot pins 15 in each pair are placed along an alignment direction inclined at an angle of about thirty degrees relative to the adjoining horizontal sidepiece 10, and at an angle of about sixty degrees relative to the abutment plane 5 when the shutter is in the closed position, as shown in FIGS. 5 and 8.

The opposed support regions 7*a*, 7*b* comprise an upper support region 7*a* and a lower support region 7*b*, placed at the upper and lower ends respectively of each vertical border 7 of framework 2.

Formed on these support regions 7*a*, 7*b* ere main portions of a channel guide 16, grooved into the framework 2 and the width in section of which is based on the cross of pivot pins 15. In detail, as shown in particular in FIG. 3, the channel guide 16 in each of said support regions 7*a*, 7*b* has different shape but has lengths at least partly symmetrical or similar with each other, defined by a first furrow 17 and a second furrow 18 consecutive and perpendicular to each other.

The first furrow 17 and second furrow 18 together define a right-angled shape the vertex of which is facing the abutment plane 5.

Each first furrow 17 begins in a blind configuration from a corner of a vertical border 7, close to a horizontal border 6, and with an inclination of substantially thirty degrees relative to the adjacent horizontal border 6 and of substantially sixty degrees relative to the abutment plane 5. It has the same length as the distance between the first and second pivot pins 15*a*, 15*b*.

Therefore, the pivot pins 15 of each pivotal-mounting region 11*a* engage the ends of the first furrow 17 when shutter 4 is in a closed position, as shown in FIGS. 5 and 8.

Each second furrow 18 is then connected to a long intermediate cut 19 extending parallelly to the abutment plane 5 and joining the second furrows 18 together.

The first and second furrows 17 and 18 form a plurality of pairs of seatings 20 for pivot pins 15, so as to define a plurality of positions for shutter 4. These seatings 20 are defined by blind ends or niches of the furrows themselves. In more detail, there are two end seatings 20*a* located at the blind ends of the first furrows 17 respectively on the corners of each vertical border 7.

Then, there are two vertex seatings 20*b* at the central vertex formed by the two right-angled furrows 17 and 18.

Two intermediate seatings 20*c* are placed along the second furrows 18, and abutment seatings 20*d* are placed at the ends of the second furrows 18 spaced apart a greater distance from said vertex.

Two auxiliary seatings 20*e* are finally provided: one along the second upper furrow 18, that is located on the side of the upper support region 7*a*, and one along the first lower furrow 17, on the side of the lower support region 7*b*. The seatings individually identified above can be operatively associated with each other in pairs so as to form, in each support region 7*a*, 7*b*, three pairs of seatings corresponding to three steady angular positions of shutter 4: a closed position, a partially open position and a completely open position. Each pair comprises two seatings spaced apart from each other by the same distance as between the two pivot pins 15. Briefly, in a closed position the first pivot pin 15*a* engages the end seating 20*a* and the second pivot pin 15*b* engages the vertex seating 20*b*.

In a position of partial opening shutter 4 is such located that the second pivot pin 15*b* engages the intermediate seating 20*c*. Finally, in a position of complete opening the second pivot pin 15*b* engages the abutment seating 20*d*. In more detail, a first pair of seatings comprises an end seating 20*a* and a vertex seating 20*b*: this first pair defines the closed position of shutter 4 shown in FIGS. 5 and 8 and the second pivot pin 15*b* is located in the vertex seating 20*b*.

A second pair of seatings defines the position of partial opening of shutter 4 and still comprises an intermediate seating 20*c* in which the second pivot pin 15*b* fits, when it leaves the former position. Associated with this intermediate seating 20*c* is, depending on whether the upper 7*a* or lower 7*b* support region is concerned, an upper vertex seating 20*b* or a lower auxiliary seating 20*e*.

A third pair of seatings still comprises an abutment seating 20*d* in which the second pivot pin 15*b* fits, as the last position of said pivot pin. Associated with this abutment seating is, depending on whether the upper support region 7*a* or lower support region 7*b* is concerned, an upper auxiliary seating 20*e* or a lower vertex seating 20*b*. This third pair defines the position of complete opening of shutter 4.

The framework 2 and shutter 4 are each of one piece construction and made of molded plastic material, and pivot pins 15 are arranged integral with shutter 4 during the molding step.

For instance, pivot pins 15 can be made of metal and fitted into the molds so as to be perfectly integral with the window shutter 4.

Preferably however, pivot pins 15 too are made of plastic material and exactly the same material as said framework and shutter, and consequently they are made during the molding step too.

The plastic material used is injection-molded polypropylene or an externally rigid end internally foamed two-component material. By the last-mentioned solution a shrinkage phenomenon is avoided.

Use of the window construction is as follows.

The window construction appears formed of only two elements, framework 2 and shutter 4, end there are no hinges to be applied for connecting the two pieces with each other. Engagement between the two elements is obtained, with reference to FIGS. 1 and 3, by grasping shutter 4—initially parallel to framework 2—and rotating the same about its first crosspiece 8*a* until pivot pins 15 on each sidepiece 11 are vertically aligned in parallel relationship with the intermediate cut 19. Then, while keeping this position of pivot pins 15, the first crosspiece 8*a* is inclined causing a slight rotation of shutter 4 about the mounting axis 5. In this position pivot pins 15 can be fitted in the intermediate cut 19 and the first crosspiece 8*a* can be then brought back to a horizontal position.

If initially pivot pins 15 are at an upper position, as shown in FIG. 1, it is necessary to make pivot pins 15 slide upwardly until they take place in seatings 20*a* and 20*b* of the first upper furrow 17.

When assembled in this manner, the construction 1 appears of the type having a shutter rotating about an upper rotation axis, adjacent to the upper horizontal rod 2*a* of framework 2. However it is also possible to make the shutter rotate about a lower rotation axis, adjacent to the lower horizontal rod 2*b* of the fixed framework 2.

As a matter of fact, the above described assembling operations can be executed starting from a position in which the first crosspiece 8*a* is at the lower part of shutter 4, as shown in FIG. 7.

Practically the shutter in FIG. 1 is to be overturned through 180 degrees about the mounting axis 5*a* or in a plane parallel to the abutment plane 5.

In this case, once pivot pins 15 have been fitted in the intermediate cut 19, they are caused to slide downwardly until they reach the first lower furrow 17.

Bolt 13*a* is usable in both cases, since the cavity 13*b* is provided on both the horizontal borders 6*a*, 6*b*.

Irrespective of how it has been mounted, shutter 4 has three use positions.

As shown in FIGS. 5 and 8, the first position is the closed one, with pivot pins 15 in the first pair of seatings 20*a* and 20*b*. This position is made steady by the framework weight and by the bolt 13*a*.

Figure 9:
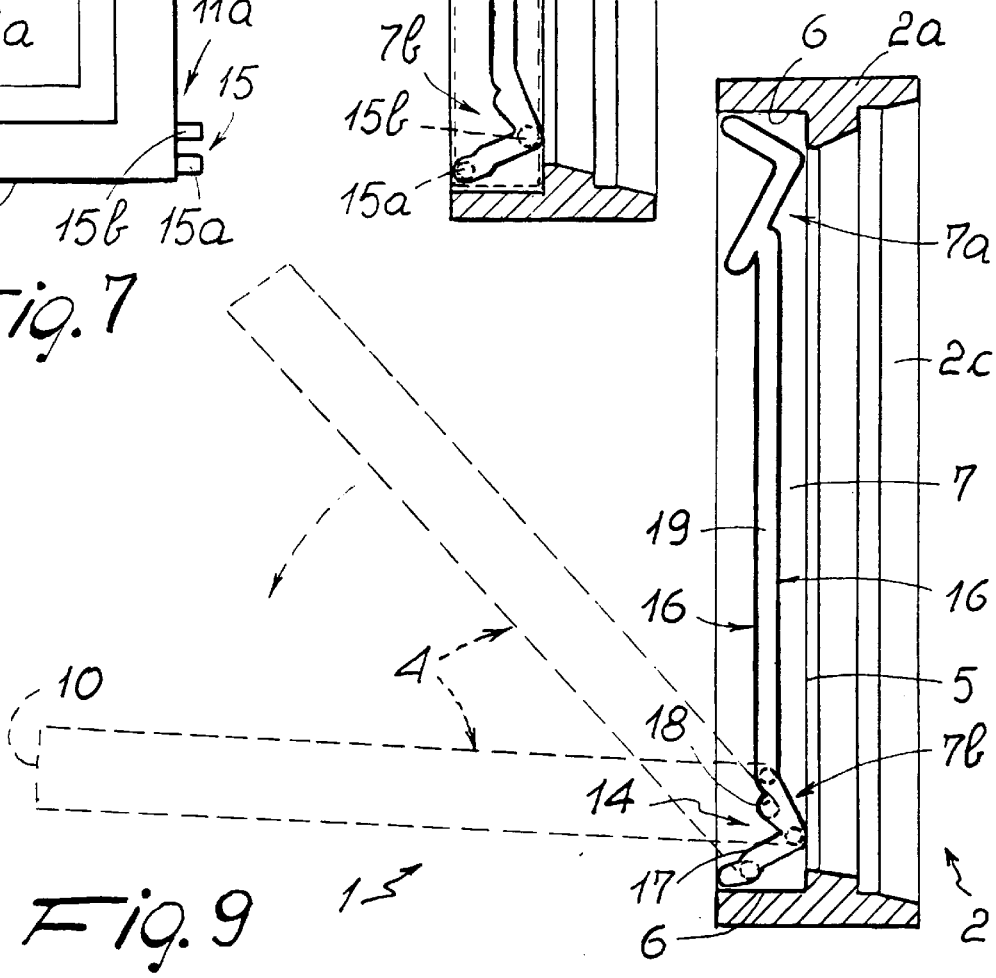
FIG. 9 is a diagrammatic overall section in which two open positions of the shutter are shown in chain lines, which shutter is represented simplified and rotating about its lower horizontal crosspiece.

The intermediate position is reached by a gradual opening bringing pivot pins 15 into the second pair of seatings, formed by one seating 20*c* and one seating 20*b* or 20*e*, as shown in FIGS. 6 and 9.

By a further rotation, as still shown in FIGS. 6 and 9, a position of complete opening is reached, with pivot pins 15 fitted into the third pair of seatings, formed of one seating 20*d* and one seating 20*e* or 20*b*.

The last-mentioned position is completely steady because the weight of shutter 4 and its being positioned in cantilevered fashion prevent the shutter itself from carrying out further movements, its displacement taking place only if it is manually raised.

In conclusion, it is pointed out that the envisaged window construction, made of only two pieces, is of simple structure, low cost and easy mounting. Above all, the shutter 4 can be selective mounted so as to rotate about a lower or upper sidepiece 10, and mounting can be redone and modified practically immediately. Irrespective of how mounted, the window construction has three use positions that are steady without requiring the presence of tie rods or struts.

I claim:

1. A multi-purpose window construction comprising;

a fixed framework having horizontal and vertical borders, and abutment projections defining an abutment plane transverse to said borders;

a mounting opening delimited by said borders;

a shutter insertable into said mounting opening and including horizontal sidepieces and vertical sidepieces positionable adjacent said horizontal and vertical borders of said fixed framework; and a connection between said shutter and said fixed framework allowing said shutter to assume a plurality of angular positions relative to said fixed framework;

wherein said connection comprises two pairs of pivot pins, each pair projecting from one of said vertical sidepieces of said shutter, and channel guides formed in said vertical borders of said framework, said channel guides comprising seatings for said pivot pins, each of said channel guides receiving one of said pairs of pivot pins;

and, wherein each of said pairs of pivot pins comprises a first pivot pin and second pivot pin spaced apart from each other by a first distance generally equal to a thickness of said shutter, said first pivot pin being located close to a corner of one of said vertical sidepieces of said shutter and said first and second pivot pins being aligned in a direction forming an angle with an adjacent one said horizontal sidepieces of said shutter.

2. The window construction as claimed in claim 1, wherein each of said vertical sidepieces of said shutter comprises, at one end thereof, a pivotal-mounting region supporting a respective one of said pairs of pivot pins, and wherein each of said vertical borders of said framework includes ends defining opposed support regions for said pairs of pivot pins, said channel guides extending at said support regions and said shutter being selectively engageable with said framework at a selected one of said opposed support regions.

3. The window construction as claimed in claim 2, wherein said channel guides include different shapes in said opposed support regions.

4. The window construction as claimed in claim 2, wherein said channel guides continuously extend between said opposed support regions.

5. The window construction as claimed in claim 1, wherein each of said channel guides includes at least one first furrow extending from a corner of one of said vertical borders and at least one second furrow consecutive and perpendicular to said first furrow, said first furrow and said second furrow defining a right-angled shape including a vertex facing said abutment plane, said first furrow including an inclination relative to an adjacent one of said horizontal borders of said framework, said first furrow having a length generally equal to a spacing between said first and second pivot pins.

6. The window construction as claimed in claim 5, wherein each of said channel guides of said vertical borders of said fixed framework comprises at least one end seating located at a blind end of said first furrow, one vertex seating located at said vertex, one intermediate seating located along said second furrow, one abutment seating located at one end of said second furrow spaced from said vertex, and an auxiliary seating located along said second furrow and distinct from said intermediate seating.

7. A window construction as claimed in claim 6, wherein said seatings are arranged to form three pairs of seatings spaced apart from each other by a second distance generally equal to the spacing between said first and second pivot pins, each of said pairs of seatings defining a respective engagement position of said first and second pivot pins in a closed position, a position of partial opening, and a position of complete opening of said shutter relative to said framework.

8. The window construction as claimed in claim 7, wherein in said closed position said first pivot pin engages said end seating and said second pivot pin engages said vertex seating, wherein in said partially open position said first pivot pin engages said vertex seating and said second pivot pin engages said intermediate seating, and wherein in said completely open position said first pivot pin engages said auxiliary seating and said second pivot pin engages said abutment seating.

9. The window construction as claimed in claim 6, wherein each of said vertical borders of said fixed framework includes said channel guides with said right-angled shape, wherein said seatings are close to both ends of said vertical borders, and wherein an intermediate cut joins together said second furrows of each of said vertical borders.

10. The window construction as claimed in claimed 5, wherein said inclination defines an angle of approximately 30 degrees.

11. The window construction as claimed in claim 1, wherein said angle is an angle of approximately 30 degrees.

12. The window construction as claimed in claim 1, further comprising a bolt on one of said horizontal sidepieces of said shutter, and cavities for said bolt in two opposed one os of said horizontal borders of said fixed framework for selectively locking said shutter at a selected one of said horizontal borders.

* * * * *